US008391737B2

(12) United States Patent
Ozeki

(10) Patent No.: US 8,391,737 B2
(45) Date of Patent: Mar. 5, 2013

(54) IMAGE FORMING APPARATUS

(75) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 430 days.

(21) Appl. No.: 12/835,282

(22) Filed: Jul. 13, 2010

(65) Prior Publication Data

US 2011/0026957 A1 Feb. 3, 2011

(30) Foreign Application Priority Data

Jul. 30, 2009 (JP) ..... 2009-178170

(51) Int. Cl.
*G03G 15/06* (2006.01)
*G03G 15/02* (2006.01)

(52) U.S. Cl. ..... 399/55; 399/50

(58) Field of Classification Search ..... 399/55, 399/50, 53, 56, 258
See application file for complete search history.

(56) References Cited

U.S. PATENT DOCUMENTS

2004/0101324 A1* 5/2004 Kawano ..... 399/55

FOREIGN PATENT DOCUMENTS

JP 08334955 A 12/1996

* cited by examiner

*Primary Examiner* — Walter L Lindsay, Jr.
*Assistant Examiner* — Billy J Lactaoen
(74) *Attorney, Agent, or Firm* — Panitch Schwarze Belisario & Nadel LLP

(57) ABSTRACT

An image forming apparatus includes an image carrier, a charging device to be applied with a charging voltage, an exposure device, a developer carrier to be applied with a development voltage, a developer supplying member to be applied with a supply voltage, a developer regulation member to be applied with a regulation voltage, and a voltage controller. The developer carrier has thereon a developer having a charge amount Q/M. The charge amount Q/M satisfies 25 [μC/g]≦|Q/M|≦40 [μC/g]. The image carrier has a surface potential Vopc, the development voltage is expressed as Vdb, and the developer carrier has a developer layer potential Vtnr thereon. The developer layer potential Vtnr relative to a difference between the surface potential Vopc and the development voltage Vdb is expressed by a ratio γ. The ratio γ satisfies 0.1≦γ≦0.2.

10 Claims, 6 Drawing Sheets

IMAGE FORMING APPARATUS

BACKGROUND OF THE INVENTION

1. Field of the Invention

The present invention relates to an image forming apparatus.

2. Description of Related Art

A related art image forming apparatus employing an electrophotographic method has served as, for example, a printer, a photocopier, a facsimile device, and a multi-functional peripheral. In the related art printer, for example, a surface of a photosensitive drum is uniformly charged by a charging roller, and is irradiated with the light by a light emitting diode (LED) head to form an electrostatic latent image thereon. After a development device disposed in the related art printer develops the electrostatic latent image to form a toner image on the photosensitive drum, the toner image is transferred to a sheet by a transfer roller and is fixed onto the sheet by a fixing device.

The development device includes a development roller, a toner supplying roller, and a development blade, and allows toner supplied from a toner cartridge to be charged, so that a thin layer of the toner is uniformly formed on the development roller. Accordingly, a development voltage, a supply voltage, and a regulation voltage are adjusted and respectively applied to the development roller, the toner supplying roller, and development blade. The toner undergoes friction between the development roller and the toner supplying roller, and between the development roller and the development blade (e.g., Patent Document 1).

Patent Document 1: Japanese Unexamined Patent Application Publication No. H08-334955

Such a related art printer, however, may cause phenomena such as blur by transfer, fog, smudge, and filming which cause deterioration of image quality in a case where a surface potential of the photosensitive drum and a setting value of the development voltage are not appropriate. The blur by transfer is a phenomenon in which the toner is not sufficiently adhered across an image portion on a sheet in the course of transfer of the toner image to the sheet. The fog is another phenomenon in which a small amount of the toner is adhered across a non-image portion (blank portion), while the smudge is a phenomenon in which the toner is locally adhered to a non-image portion, a half-tone portion and the like in a granular manner, a streak manner, or a band-like manner. The filming is another phenomenon in which a white portion is locally formed in a granular shape, a streak shape, or a band-like shape when a solid image is printed across the sheet.

The present invention is proposed in consideration of the aforementioned situations, and provides an image forming apparatus capable of reducing occurrences of blur by transfer, fog, smudge, filming, and the like, thereby improving image quality.

BRIEF SUMMARY OF THE INVENTION

According to an aspect of the present invention, an image forming apparatus includes: an image carrier; a charging device, applied with a charging voltage, charging a surface of the image carrier; an exposure device forming a latent image by allowing the charged surface of the image carrier to be exposed to light thereof; a developer carrier, applied with a development voltage, forming a developer image by development of the latent image by allowing a developer to be adhered to the image carrier; a developer supplying member, applied with a supply voltage, supplying the developer to the developer carrier; a developer regulation member, applied with a regulation voltage, regulating an amount of the developer on the developer carrier; and a voltage controller controlling the charging voltage, the development voltage, the supply voltage, and the regulation voltage. The developer carrier has thereon the developer having a charge amount Q/M, and the charge amount Q/M satisfies 25 [μC/g]≦|Q/M|≦40 [μC/g]. The image carrier has a surface potential Vopc; the development voltage is expressed as Vdb; and the developer carrier has a developer layer potential Vtnr thereon. The developer layer potential Vtnr relative to a difference between the surface potential Vopc and the development voltage Vdb is expressed by a ratio γ satisfying $0.1 \leqq \gamma \leqq 0.2$.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the present invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
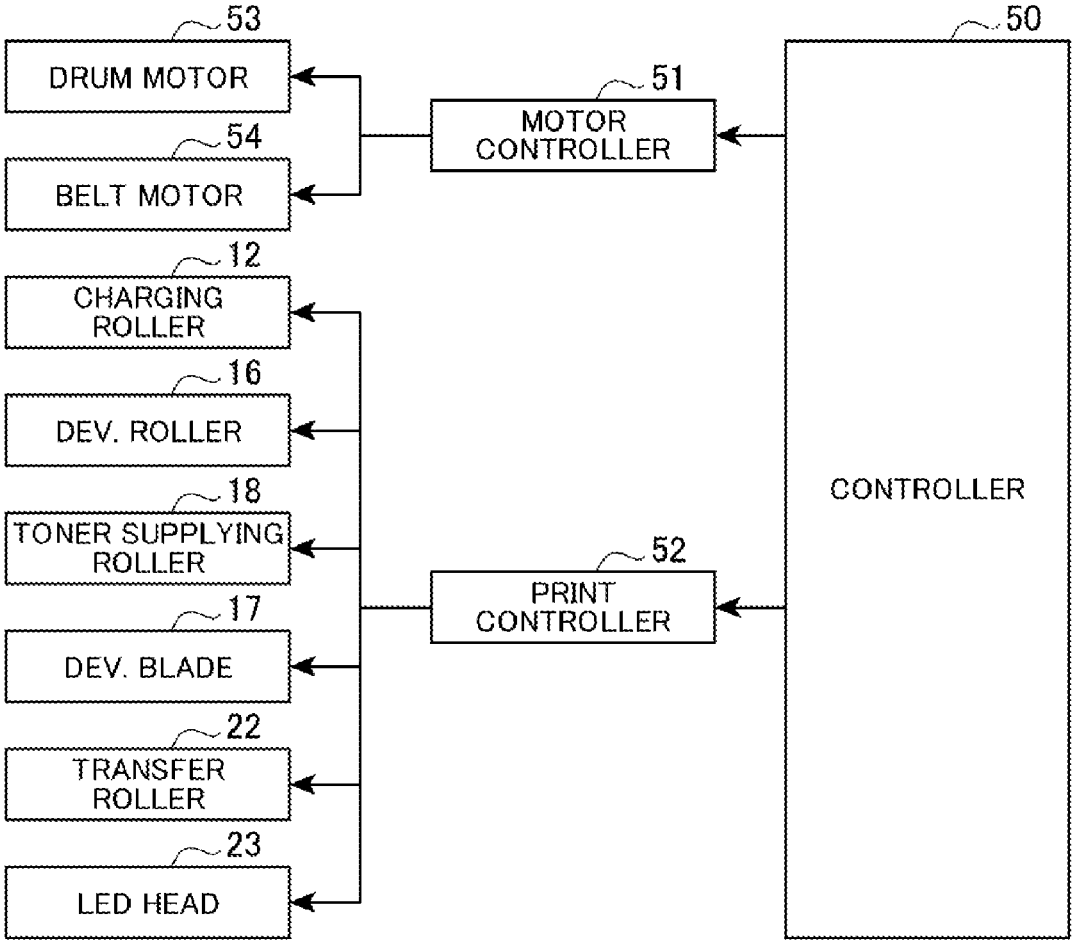
FIG. 1 is a control block diagram for a printer serving as an image forming apparatus according to a first embodiment of the present invention.

A printer serving as an image forming apparatus according to preferred embodiments of the present invention is now described more fully hereinafter with reference to the accompanying drawings. The present invention may, however, be embodied in many different forms and should not be construed as limited to the embodiments set forth herein. The embodiments, therefore, may be modified or varied without departing from the scope of the present invention.

In describing embodiments illustrated in the drawings, specific terminology is employed for the sake of clarity. However, the disclosure of the patent specification is not intended to be limited to the specific terminology so selected, and it is to be understood that each specific element includes all technical equivalents that operate in a similar manner. Preferred embodiments of the present invention are described in detail referring to the drawings, wherein like reference numerals designate identical or corresponding parts throughout the several views.

Figure 2:
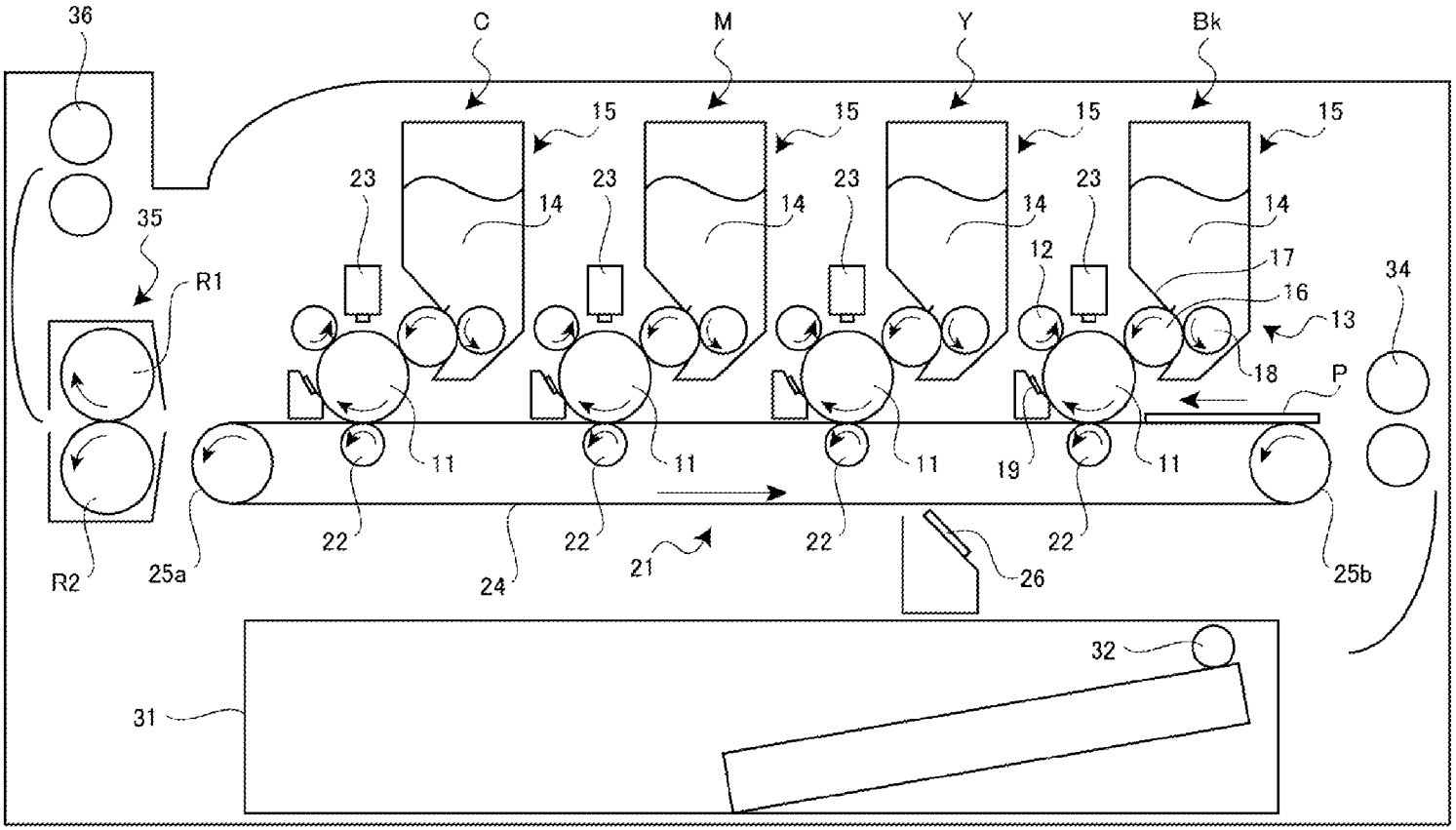
FIG. 2 is a schematic diagram illustrating the printer according to the first embodiment of the present invention.
Figure 3:
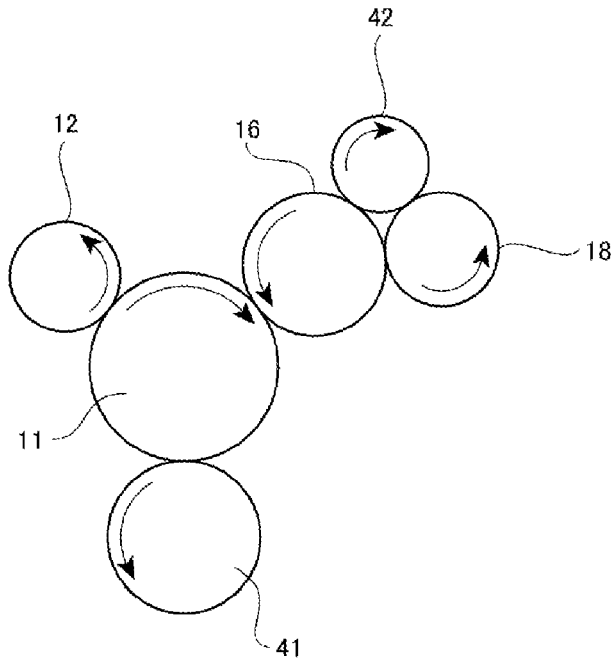
FIG. 3 is a schematic diagram illustrating a drive system of a photosensitive drum according to the first embodiment of the present invention.

Referring to FIGS. 2 and 3, the printer serving as the image forming apparatus and a drive system of a photosensitive drum in the printer according to the first embodiment of the present invention are respectively illustrated.

The printer serving as the image forming apparatus includes thereinside: image forming portions Bk, Y, M, and C disposed with respect to respective toners 14 serving as developers of black, yellow, magenta, and cyan, respectively; and a transfer unit 21 disposed along the image forming portions Bk, Y, M, and C, as illustrated in FIG. 2. Each of the image forming portions Bk, Y, M, and C includes: an image forming unit 15; a light emitting diode (LED) head 23 serving as an exposure device disposed corresponding to the image forming unit 15; and a transfer roller 22 serving as a transfer member.

Since the image forming portion Bk, Y, M, and C are substantially similar to one another except for the color of the toner, the image forming unit 15 in the image forming unit Bk will be described.

The image forming unit 15 includes a toner cartridge 13, serving as a developer storage unit, detachably disposed thereto. The toner cartridge 13 stores the toner 14 thereinside.

The image forming unit 15 includes: a photosensitive drum 11 serving as an image carrier; a charging roller 12 serving as a charging device; a development roller 16 serving as a developer carrier; and a cleaning blade 19 serving as a first cleaning member. The photosensitive drum 11 is formed in a drum shape, and carries an electrostatic latent image as a latent image on a surface thereof. The charging roller 12 is disposed in the vicinity of the photosensitive drum 11 in such a manner as to be in contact with the photosensitive drum 11, and uniformly charges the surface of the photosensitive drum 11. The development roller 16 is disposed in contact with the photosensitive drum 11, and allows the toner 14 to be adhered to the surface of the photosensitive drum 11, so that the electrostatic latent image on the surface of the photosensitive drum 11 is developed to form a toner image serving as a developer image.

Moreover, the image forming unit 15 includes: a toner supplying roller 18 not only serving as a developer supplying member but also serving as a developer supplying roller; and a development blade 17 serving as a developer regulation member. The toner supplying roller 18 is disposed in contact with the development roller 16. The toner supplying roller 18 allows the toner 14 supplied from the toner cartridge 13 to be charged, and supplies the toner 14 to the development roller 16. The development roller 16, the development blade 17, and the toner supplying roller 18, for example, form a development unit.

The photosensitive drum 11 is formed of a charge generation layer having a film thickness of 0.5 μm and a charge transport layer having a film thickness of 18 μm provided on an aluminum tube having a thickness of 0.75 mm and an outside diameter of 30 mm. The charge generation layer can be formed of a charge generation material such as organic pigment and dye made of, for example, selenium, selenium alloy, a selenium arsenic compound, cadmium sulfide, zinc oxide, other inorganic photoconductive material, phthalocyanine, azo color, quinacridon, polycyclic quinone, pyrylium salt, thiapyrylium salt, indigo, thioindigo, anthanthrone, pyranthrone, and cyanine. The charge transport layer can be formed of a charge transport material made of, for example, aniline derivative, a hydrazone compound, aromatic amino-derivative, stilbene derivative, and a heterocyclic compound such as carbazol, indole, imidazole, oxazole, pyrazole, oxadiazole, pyrazoline, and thiadiazole, or a electron-donating material such as a polymer including a group made by combination of such substances or materials in a main chain or a side chain.

The charging roller 12 uniformly charges the surface of the photosensitive drum 11. For example, the charging roller 12 is formed of a conductive member serving as a shaft made of stainless steel and the like and a conductive elastic layer made of epichlorohydrin and the like, and is disposed in contact with the photosensitive drum 11.

The LED head 23 allows the uniformly charged surface of the photosensitive drum 11 to be selectively exposed to the light thereof, thereby forming the electrostatic latent image (latent pattern) on the surface of the photosensitive drum 11. The LED head 23 includes an LED element, an LED drive element, and a lens array, and allows image formation on the surface of the photosensitive drum 11 with the irradiation light from the LED element.

The development roller 16 is formed of a conductive shaft (e.g., metal core) made of a SUS material (SUS represents stainless used steel standardized by Japanese Industrial Standards), an elastic layer provided on the conductive shaft in such a manner as to be in a roll shape, and a surface layer covering the elastic layer. For the elastic layer, urethane rubber or silicone rubber is used. The surface layer is formed by processing a surface of the elastic layer with urethane solution, or by applying acrylic resin, acrylic-fluoro copolymer resin and the like on the surface of the elastic layer. In a case where the surface layer is formed of the acrylic resin, acrylic-fluoro copolymer resin and the like, carbon black is blended in the acrylic resin to impart the conductivity to the surface layer. Herein, one (1) part by weight of the carbon black is blended to one hundred (100) parts by weight of the acrylic resin.

The toner supplying roller 18 is formed of a conductive shaft (metal core) made of a SUS material, and an elastic layer. For the elastic layer, conductive silicone rubber foam or conductive urethane rubber foam is used. In a case where an elastic layer having a semi-conductive property is used, for example, acetylene black and carbon black are added.

The development blade 17 is formed of a SUS material having a thickness of 0.08 mm. The development blade 17 includes a contact portion contacting the development roller 16, and the contact portion undergoes a bending process to form a bending portion having a curvature radius R of 0.2 mm. The development blade 17 has a linear pressure of 30 gf/cm with respect to the development roller 16. The curvature radius R and the linear pressure of the development blade 17 can be adjusted according to the charge amount of the toner 14.

The cleaning blade 19 is, for example, formed of a rubber blade, and is disposed in such a manner that an edge of the rubber blade contacts the surface of the photosensitive drum 11.

The photosensitive drum 11 is rotated at a constant linear speed (i.e., a circumferential speed which is a speed of an outer circumference) by gear transmission provided with a drum drive gear 41 as illustrated in FIG. 3. The drum drive gear 41 is rotated with the drive of a drum motor 53 serving as a first drive unit. The charging roller 12 is rotated by friction transmission provided with the surface of the photosensitive drum 11, and the development roller 16 is rotated by the gear transmission provided with the photosensitive drum 11. The toner supplying roller 18 is rotated by the gear transmission provided with the development roller 16 through an idler gear 42.

The development roller 16 is rotated in a direction opposite to the rotation direction of the photosensitive drum 11 at a linear speed ratio of 1.6 times relative to the photosensitive drum 11. The toner supplying roller 18 is rotated in the same direction as the development roller 16 at a linear speed ratio of 0.7 time. According to the first embodiment, the linear speed ratio represents a circumferential speed ratio, and the linear speed ratio of the development roller 16 relative to the photosensitive drum 11 represents a ratio of the circumferential speed of the development roller 16 relative to that of the photosensitive drum 11.

The transfer unit 21 includes: a drive roller 25*a* serving as a first roller; an idler roller 25*b* serving as a second roller; a transfer belt 24, serving as belt member, tightly stretched by the drive roller 25*a* and the idler roller 25 and travelably disposed in contact with each of the photosensitive drums 11; and the transfer rollers 22 disposed opposite to the respective photosensitive drums 11 through the transfer belt 24. Each of the transfer rollers 22 is, for example, formed of a foam elastic member having a conductive property.

In a lower portion of the transfer belt 24, a cleaning blade 26, serving as a second cleaning member, is disposed in the vicinity of the idler roller 25*b* disposed on the most downstream side relative to a traveling direction of the transfer belt 24, thereby cleaning the transfer belt 24.

A sheet feed cassette 31, serving as a medium storage unit, is disposed below the transfer unit 21 to store a sheet P serving as a medium or a plurality of sheets Ps. A hopping roller 32 is disposed in one end of the sheet feed cassette 31. Each of the sheets Ps is separately fed from the sheet feed cassette 31 by the hopping roller 32, and is fed to the image forming portions Bk, Y, M, and C through a conveyance roller 34.

A fixing unit 35, serving as a fixing device, is disposed on a downstream side of the image forming portions Bk, Y, M, and C relative to a conveyance direction of the sheet P. The fixing unit 35 includes a fixing roller R1 serving as a first roller and a pressure roller R2 serving as a second roller. The fixing unit 35 allows a color toner image on the sheet P conveyed from the image forming portions Bk, Y, M, and C to be fixed by the fixing roller R1 and the pressure roller R2, thereby forming the color image. The color image formed on the sheet P is ejected outside the printer by an ejection roller 36.

The photosensitive drum 11, the charging roller 12, the LED head 23, the development roller 16, the toner supplying roller 18, the transfer roller 22, the drive roller 25*a*, the idler roller 25*b* and the fixing unit 35 are controlled by a control unit (not shown). The control unit applies the direct voltage to the charging roller 12, the transfer roller 22, the development roller 16, and the toner supplying roller 18 at a prescribed timing arranged beforehand, and drives the drum motor, so that the photosensitive drum 11, the charging roller 12, the development roller 16, the toner supplying roller 18, and the fixing roller R1 are rotated in directions indicated by respective arrows shown in FIG. 2. Accordingly, the control unit allows a belt motor (not shown) serving as a drive unit for traveling to be driven, thereby rotating the drive roller 25*a* in a direction indicated by an arrow shown in FIG. 2.

A description is now given of the toner 14.

According to the first embodiment of the present invention, the toner 14 is formed as follows: toner particles are formed by an emulsion polymerization method; and silica, titanium oxide fine particles, and the like are added to the toner particles and mixed by a mixer. The toner 14 is formed to have an average particle size smaller than or equal to 6 μm.

The emulsion polymerization method represents a method for producing a toner particle as follows: a primary particle of a styrene-acrylic copolymer resin serving as a blinding resin for the toner 14 is produced in solvent; a colorant emulsified by an emulsifying agent (a surface active agent) is mixed with the solvent used for primary particle production; a wax, a charge control agent, and the like are mixed as may be needed; and such a mixture is aggregated to produce the toner particles. The toner particles removed from the solvent are washed and dried, so that an unnecessary solvent component and a by-product component are removed from the toner particle.

According to the first embodiment, the styrene-acrylic copolymer resin is generated from styrene, acrylic acid, and methylmethacrylate. The colorant includes the carbon black, pigment yellow 74, pigment red 238, and pigment blue 15:3 used as black, yellow, magenta, and cyan, respectively. Moreover, the wax includes stearyl stearate used as high-class fatty acid ester wax.

A description is now given of a control device of the printer.

Referring to FIG. 1, the printer according to the first embodiment of the present invention is illustrated in a control block diagram.

As illustrated in FIG. 1, a controller 50 is connected to a motor controller 51 and a print controller 52. The motor controller 51 is connected to the drum motor 53 and a belt motor 54. The motor controller 51, functioning as a drive controller, drives the drum motor 53 to rotate the photosensitive drum 11 and the like, and drives the belt motor 54 to allow the transfer belt 24 to travel. Upon receipt of a print instruction from the controller 50, the print controller 52 functions as a voltage controller and a light emission controller, so that print operation is performed. Herein, the printer controller 52, functioning as the voltage controller, controls each of a charging voltage, a development voltage, a supply voltage, a regulation voltage, and a transfer voltage to be applied to the charging roller 12, the development roller 16, the toner supplying roller 18, the development blade 17, and the transfer roller 22, respectively. The print controller 52, functioning as the light emission controller, controls a light emission amount of the LED head 23.

A description is now given of operation of the printer.

First, the printer controller 52 allows the charging voltage to be applied to the charging roller 12 to uniformly charge the surface of the photosensitive drum 11, and allows the LED head 23 to emit the light based on image data from the controller 50, thereby forming the electrostatic latent image on the surface of the photosensitive drum 11. Second, the print controller 52 allows the development voltage to be applied to the development roller 16 including a thin toner layer formed on a surface thereof to develop the electrostatic latent image on the photosensitive drum 11, thereby forming the toner image. Herein, the print controller 52 adjusts each of the supply voltage and the regulation voltage so that the thin toner layer having a uniform thickness, that is, the toner layer serving as a developer layer, is formed on the development roller 16, and an average charge amount serving as a charge amount of the toner in the toner layer is adjusted to a prescribed value. The printer controller 52 also changes one of the charging voltage and the development voltage to adjust the average charge amount to the prescribed value.

Third, the print controller 52 allows the transfer voltage to be applied to the transfer roller 22, and allows the transfer belt 24 to travel by the belt motor 54, so that the toner images of the respective colors on the respective photosensitive drums 11 are sequentially superimposed and transferred to the sheet P, thereby forming a color toner image. The color toner image formed on the sheet P is fixed by the fixing unit 35, thereby forming a color image. The sheet P with the color image formed thereon is ejected outside the printer by the ejection roller 36, and the print operation is completed.

After the toner image is transferred from the photosensitive drum 11, the surface of the photosensitive drum 11 may have a small amount of the toner 14 remained thereon. The cleaning blade 19 scrapes and removes the remaining residual toner 14 from the surface of the photosensitive drum 11.

In a case where the printer is operated in the normal temperature and humidity environment using the toner to be charged with a negative polarity, that is, a toner having a negative charge property, for example, the voltages are set as follows: the charging voltage is set to −100 V, the development voltage is set to −200 V, the supply voltage is set to −300 V, and the regulation voltage is set to −300 V. When the charging roller 12 is applied with the charging voltage higher than or equal to the prescribed value, the surface of the photosensitive drum 11 is charged, and a surface potential being proportional to the charging voltage is generated. For example, where the charging voltage is −1100 V, the surface potential of −600 V is generated on the surface of the photosensitive drum 11. Accordingly, a potential on a portion of the electrostatic latent image formed with the light emitted from the LED head 23, that is, a latent image potential, becomes −50 V, and the toner 14 supplied from the development roller 16 is adhered to the electrostatic latent image, thereby performing reverse development. In a case where a toner to be charged with a positive polarity, that is, a toner having a positive charge property, is used, each of the voltages has a reverse property in terms of positive and negative.

According to the first embodiment of the present invention, the charging voltage is set to be in a range between −1000 V and 1200 V (i.e., higher than or equal to −1000 V and lower than or equal to 1200 V), the surface potential of the photosensitive drum 11 is set to be in a range between −500 V and 700 V (i.e., higher than or equal to −500 V and lower than or equal to 700 V), and the development voltage is set to be in a range between −100 V and 300 V (i.e., higher than or equal to −100 V and lower than or equal to 300 V).

In a case where the print speed increases, the toner image formed on the surface of the photosensitive drum 11 is not surely transferred to the sheet P, causing blur by transfer. The blur by transfer is a phenomenon in which the toner 14 is not sufficiently adhered across an image portion on the sheet P in the course of transfer of the toner image to the sheet P.

Figure 4:
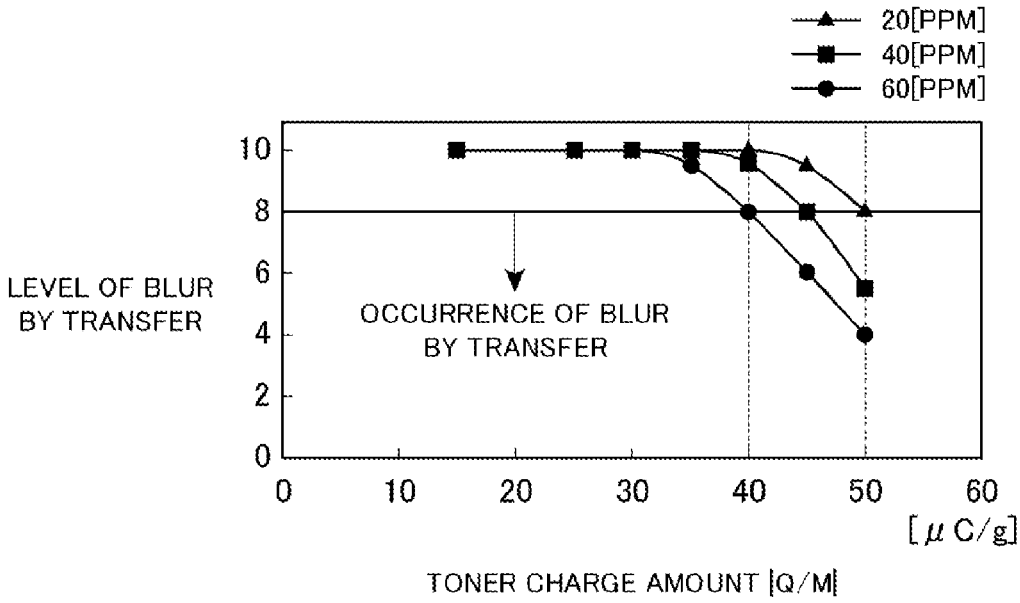
FIG. 4 is a diagram illustrating a relationship between a charge amount of toner and an evaluation level of blur by transfer according to the first embodiment of the present invention.

A description is now given of a relationship between a charge amount Q/M of the toner 14 on the development roller 16, the print speed, and an evaluation level of the blur by transfer with reference to FIG. 4. A horizontal axis indicates the charge amount Q/M of the toner 14, and a vertical axis indicates the evaluation level of the blur by transfer. Since the toner charge amount Q/M has a plus or minus sign depending upon the positive charge property or negative charge property of the toner, the toner charge amount Q/M indicates an absolute value or is expressed using the absolute value |Q/M| as may be necessary.

As illustrated in FIG. 4, the print speed is set to 20 PPM, 40 PPM, and 60 PPM, and the charge amount Q/M of the toner 14 is changed to examine occurrences of the blur by transfer. The higher the print speed, the greater the possibility of the blur by transfer to occur.

Accordingly, the print speed was set to 60 PPM, and an experiment was conducted to obtain a condition under which the blur by transfer does not occur even in a case where the print speed is fast. Where the print speed was set to 60 PPM, the photosensitive drum 11 had a linear speed of 265 mm/s.

In such a case, the charge amount Q/M of the toner 14 was calculated as follows: an electrical charge Q of the toner 14 was measured by a portable draw-off type measurement instrument (Model 210HS-3 available from TREK, Inc.); a mass M of the toner 14 was measured by an electronic balance instrument (CP225D available from Sartorius Corp.) at the time of measuring the electrical charge Q; and the electrical charge Q was divided by the mass M. The surface potential of the photosensitive drum 11 and a potential of the toner layer on the development roller 16, that is, a toner layer potential, were measured by a surface potential measurement instrument (Model 344 available from TREK, Inc.).

The charge amount Q/M of the toner 14 on the development roller 16 and the toner layer potential on the development 16 were measured in a measurement point between a contact point with the development blade 17 on the circumference of the development roller 16 and a contact point with the photosensitive drum 11. The surface potential on the photosensitive drum 11 was measured in a measurement point between a contact point with the charging roller 12 on the circumference of the photosensitive drum 11 and a contact point with the development roller 16.

Moreover, a color difference ΔE was used as an index to indicate a level of fog. The color difference ΔE was calculated by comparing a Lab value of the sheet P prior to the print operation, that is, the Lab value of a not-yet-print sheet, and the Lab value of a non-image portion (i.e., blank portion) on the sheet P subsequent to the print operation. The Lab value was measured using a spectral colorimeter (CM-2600d available from Konica Minolta Holdings, Inc.). The lower the value of the color difference ΔE, the lower the possibility of the fog occurrence. Therefore, the image quality is high.

The evaluation level of the blur by transfer was evaluated on a ten-level scale according to density of a solid image printed on the sheet P. Herein, the solid image was printed across the sheet P having a size of A4, and the density of the solid image on the sheet P was measured. The density was measured using a spectral densitometer (X-Rite 528 available from X-Rite, Incorporated). The higher the level of evaluation scale, the lower the possibility of the blur occurrence. Therefore, the image quality is high.

Figure 5:
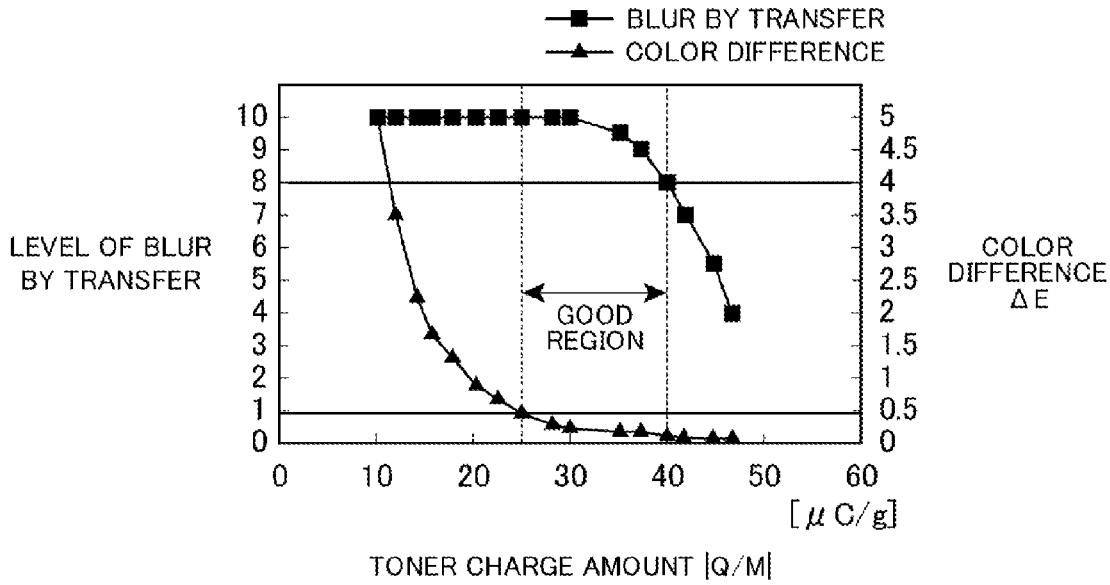
FIG. 5 is another diagram illustrating a relationship between a charge amount of toner, an evaluation level of blur by transfer, and a color difference according to the first embodiment of the present invention.

Referring to FIG. 5, a description is given of a relationship between the charge amount of the toner 14, the evaluation level of the blur by transfer, and the color difference ΔE according to the first embodiment of the present invention. A horizontal axis indicates the charge amount of the toner 14, a left vertical axis indicates the evaluation level of the blur by transfer, and a right vertical axis indicates the color difference ΔE.

As illustrated in FIG. 5, the greater the toner charge amount Q/M, the lower the evaluation level of the blur by transfer and the smaller the color difference ΔE. Consequently, the blur by transfer tends to occur, and the fog tends not to occur. According to the first embodiment, following ranges are applied:

- A suppression range of the fog occurrence: The color difference ΔE is smaller than or equal to 0.5
- A suppression range of the blue by transfer: Level 8 or higher
- A preferable range for the charge amount Q/M of the toner 14:

$$25\ [\mu C/g] \leqq |Q/M| \leqq 40\ [\mu C/g]$$

Although the toner has the positive charge property and negative charge property, a similar trend is provided except for a reverse sign. Therefore, a range for the charge amount Q/M of the toner 14 is expressed using the absolute value as above.

Now, a description is given of a relationship between a ratio "r" and smudge and filming. The ratio γ is determined as follows:

$$\gamma = Vtnr/(Vopc - Vdb)$$

where "Vtner" indicates the potential of the toner layer on the development roller 16, that is, the toner layer potential serving as the developer layer potential, "Vopc" indicates the surface potential of the photosensitive drum 11, and "Vdb" indicates the development voltage. Accordingly, the ratio γ presents the toner layer potential "Vtnr" relative to a difference between the surface potential Vopc and the development voltage Vdb. The relationship between the ratio γ and the smudge and the filming is shown in TABLE 1 below.

TABLE 1

| $\frac{Vtnr}{Vopc - Vdb}$ | 0.05 | 0.10 | 0.15 | 0.20 | 0.25 | 0.30 |
|---|---|---|---|---|---|---|
| SMUDGE | ○ | ○ | ○ | ○ | x | x |
| FILMING | x | ○ | ○ | ○ | ○ | ○ |

As shown in TABLE 1, where the ratio γ is below 0.1, the filming occurs. Where the ratio γ is greater than or equal to 0.2, on the other hand, the smudge occurs. Accordingly, the print controller 52 adjusts the ratio γ to be in a range stated below by changing the surface potential Vopc and the development voltage Vdb so as to enhance the image quality.

$$0.1 \leqq \gamma \leqq 0.2$$

The print controller 52 can change one of the surface potential Vopc and the development voltage Vdb to adjust the ratio γ.

The first embodiment, therefore, can suppress the occurrences of the blur by transfer, the fog, the smudge, the filming, and the like by changing the surface potential Vopc and the development voltage Vdb in such a manner that the ratio γ is arranged in the range of $0.1 \leqq \gamma \leqq 0.2$ in a case where the preferable range for the charge amount Q/M of the toner 14 is expressed using the absolute value as $25\ [\mu C/g] \leqq |Q/M| \leqq 40\ [\mu C/g]$.

A description is now given of a printer serving as an image forming apparatus according to a second embodiment of the present invention. Components and configuration of the printer similar to the first embodiment are given the same reference numerals as above, and an advantage derived from the same configuration as above can be provided.

Figure 6:
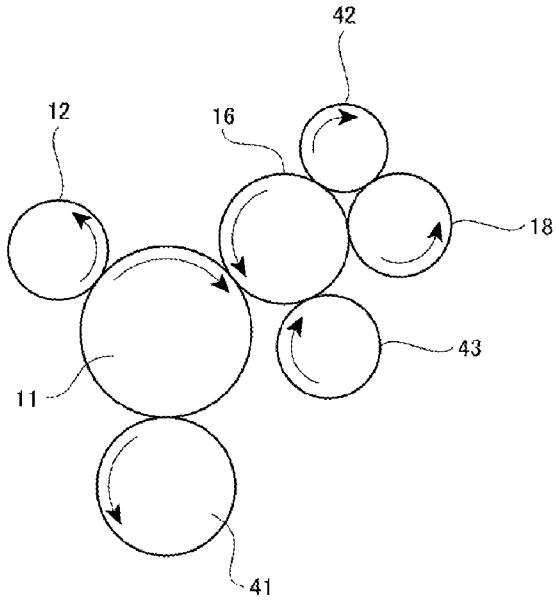
FIG. 6 is a schematic diagram illustrating a drive system of a photosensitive drum according to a second embodiment of the present invention.

Referring to FIG. 6, a drive system of a photosensitive drum according to the second embodiment of the present invention is illustrated.

According to the second embodiment, a roller motor (not shown) serving as a second drive unit is coupled with a development roller 16 in such a manner that a linear speed ratio of the development roller 16 serving as a developer carrier relative to a photosensitive drum 11 serving as an image carrier can be changed according to density of an image formed on a sheet P serving as a medium.

The photosensitive drum 11 is rotated at a constant linear speed by gear transmission provided with a drum drive gear 41 as illustrated in FIG. 6. The drum drive gear 41 is rotated by the drive of a drum motor 53 (i.e., substantially similar to the drum motor 53 of FIG. 1 described in the above embodiment) serving as a first drive unit. A charging roller 12 serving as a charging device is rotated by friction transmission provided with a surface of the photosensitive drum 11, and the development roller 16 is rotated by the gear transmission provided with a roller drive gear 43. The roller drive gear 43 is rotated by the drive of the roller motor. A toner supplying roller 18, serving as a developer supplying member and a developer supplying roller, is rotated by the gear transmission provided with the development roller 16 through an idler gear 42.

The development roller 16 is rotated at a prescribed linear speed ratio in a direction opposite to the rotation direction of the photosensitive drum 11. The toner supplying roller 18 is rotated in the same direction as the development roller 16 at a linear speed ratio of 0.7 time that is set beforehand. A motor controller 51, functioning as a drive controller, can change one of the rotation speeds of the drum motor 53 and the roller motor, so that the linear speed ratio of the development roller 16 relative to the photosensitive drum 11 can be changed. According to the second embodiment, the motor controller 51 changes the rotation speed of the roller motor, so that the linear speed ratio of the development roller 16 relative to the photosensitive drum 11 is changed.

Figure 7:
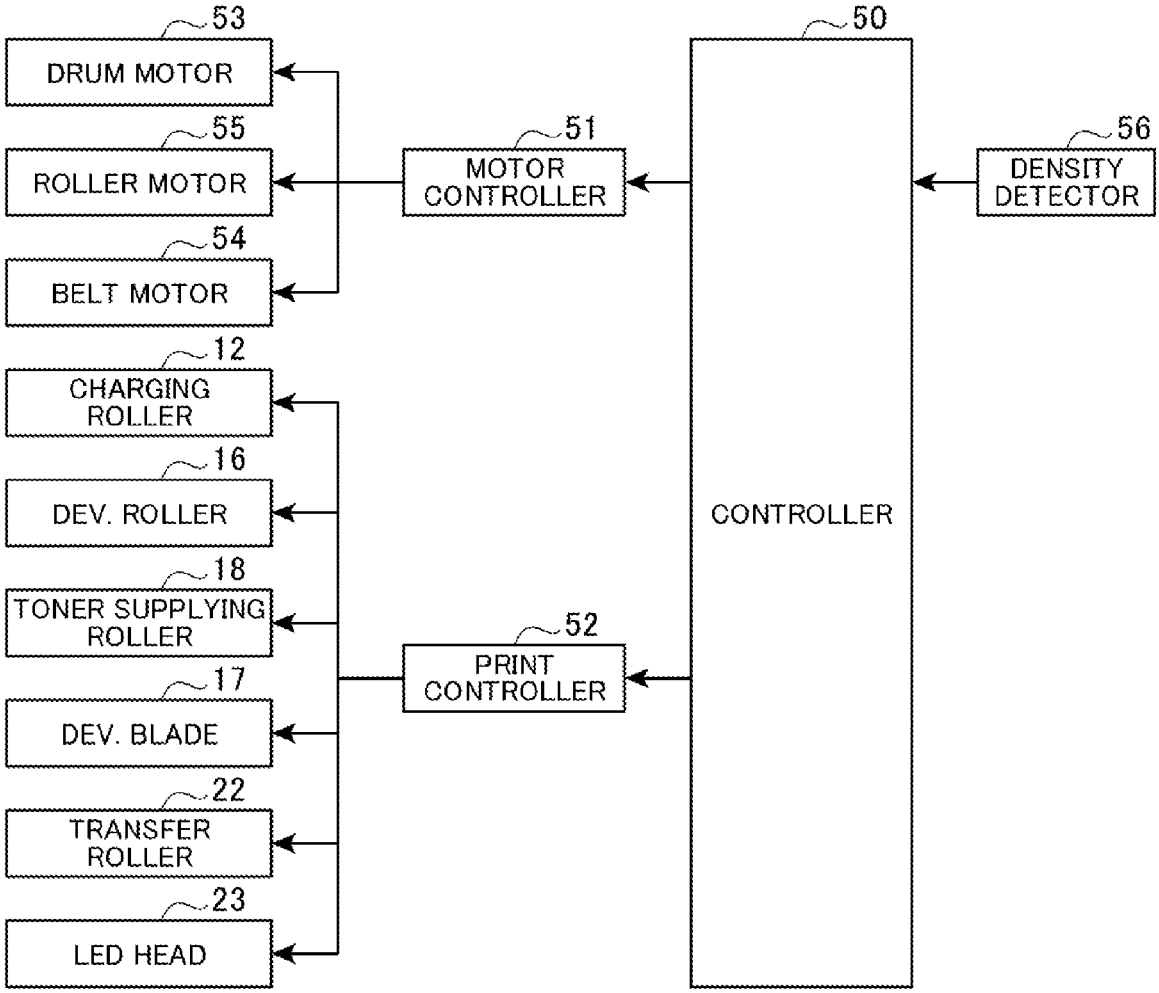
FIG. 7 is a control block diagram for a printer serving as an image forming apparatus according to a second embodiment of the present invention.

Referring to FIG. 7, the printer according to the second embodiment of the present invention is illustrated in a control block diagram.

A density detector 56 detects the density of the toner image serving as a developer image formed on a transfer belt 24 (i.e., substantially similar to the transfer belt 24 of FIG. 2 described in the above embodiment) serving as a belt member. The density detector 56 is disposed opposite to the transfer belt 24, and transmits the detected density to a controller 50. Accordingly, the toner image is formed in a prescribed pattern on the transfer belt 24. After the density is detected, the toner image is scraped and removed from the transfer belt 24 by a cleaning blade 26 (i.e., substantially similar to the cleaning blade 26 of FIG. 2 described in the above embodiment) serving as a second cleaning member.

The motor controller 51 is connected to the drum motor 53, a belt motor 54, and a roller motor 55. The motor controller 51 drives the drum motor 53 to rotate the photosensitive drum 11 and the like, drives the belt motor 54 to allow the transfer belt 24 to travel, and drives the roller motor 55 to rotate the development roller 16.

According to the second embodiment, when the density detected by the density detector 56 is transmitted to the controller 50, the motor controller 51 changes the linear speed ratio of the development roller 16 relative to the photosensitive drum 11 by changing the rotation speed of the roller motor 55 based on an instruction from the controller 50.

Figure 8:
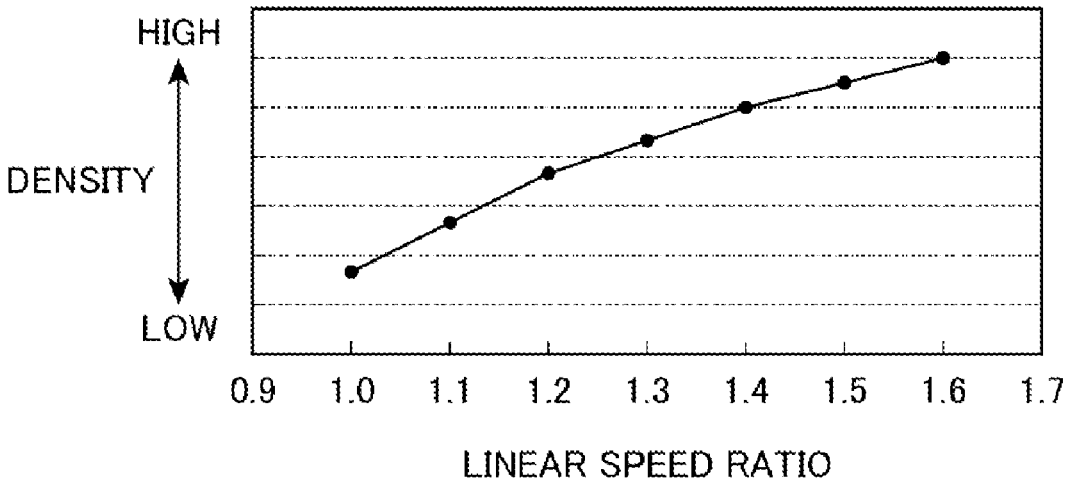
FIG. 8 is a diagram illustrating a relationship between a linear speed ratio and density according to the second embodiment of the present invention.

Referring to FIG. 8, a description is given of a relationship between the linear speed ratio and the density according to the second embodiment of the present invention. A horizontal axis indicates the linear speed ratio, and a vertical axis indicates the density.

As illustrated in FIG. 8, the higher the linear speed ratio of development roller 16 relative to the photosensitive drum 11, the higher the density.

A print controller 52 functions as a rotation controller. Where the density detected by the density detector 56 is high, the print controller 52 decreases the linear speed ratio by reducing the rotation speed of the roller motor 55. Where the density is low, on the other hand, the print controller 52 increases the linear speed ratio by increasing the rotation speed of the roller motor 55.

According to the first embodiment described above, the surface potential Vopc and the development voltage Vdb are adjusted, so that the likelihood of the smudge and the filming occurrences are suppressed. However, the adjustment of the development voltage Vdb may cause deterioration of the image density. According to the second embodiment, on the other hand, the motor controller 51 increases the linear speed ratio of the development roller 16 relative to the photosensitive drum 11 by changing the rotation speed of the roller motor 55 based on the density detected by the density detector 56, thereby reducing the likelihood of the image density deterioration.

Therefore, the image quality can be enhanced according to the second embodiment of the present invention.

Each of the above first and second embodiments of the present invention is described using the printer as the example of the image forming apparatus. However, the present invention can be applied to a photocopier, a facsimile device, a multi-functional peripheral, and the like.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. An image forming apparatus comprising:

an image carrier;

a charging device, applied with a charging voltage, charging a surface of the image carrier;

an exposure device forming a latent image by allowing the charged surface of the image carrier to be exposed to light thereof;

a developer carrier, applied with a development voltage, forming a developer image by development of the latent image by allowing a developer to be adhered to the image carrier;

a developer supplying member, applied with a supply voltage, supplying the developer to the developer carrier;

a developer regulation member, applied with a regulation voltage, regulating an amount of the developer on the developer carrier; and a voltage controller controlling the charging voltage, the development voltage, the supply voltage, and the regulation voltage, wherein the developer carrier has thereon the developer having a charge amount Q/M, the charge amount Q/M satisfying 25 [μC/g]≦|Q/M|≦40 [μC/g], and wherein the image carrier has a surface potential Vopc, the development voltage is expressed as Vdb, and the developer carrier has a developer layer potential Vtnr thereon, the developer layer potential Vtnr relative to a difference between the surface potential Vopc and the development voltage Vdb being expressed by a ratio γ satisfying $0.1 \leqq \gamma \leqq 0.2$.

2. The image forming apparatus according to claim 1, further comprising:

a belt member;

a density detector detecting density of the developer image formed on the belt member;

a first drive unit allowing the image carrier to rotate;

a second drive unit allowing the developer carrier to rotate; and a drive controller driving the first and second drive units to rotate the image carrier and the developer carrier at a prearranged linear speed ratio of the developer carrier relative to the image carrier.

3. The image forming apparatus according to claim 1, wherein the voltage controller adjusts an average charge amount of the developer by changing the supply voltage and the regulation voltage.

4. The image forming apparatus according to claim 1, wherein the voltage controller adjusts an average charge amount of the developer by changing one of the charging voltage and the development voltage.

5. The image forming apparatus according to claim 1, wherein the voltage controller adjusts the ratio γ by changing the charging voltage and the development voltage.

6. The image forming apparatus according to claim 1, wherein the voltage controller adjusts the ratio γ by changing one of the charging voltage and the development voltage.

7. The image forming apparatus according to claim 2, wherein the drive controller changes a rotation speed of the developer carrier based on the image density detected by the density detector.

8. The image forming apparatus according to claim 1, wherein the image carrier has a linear speed lower than or equal to 265 mm/s.

9. The image forming apparatus according to claim 1, wherein the developer carrier has an elastic layer formed of at least one of urethane rubber and silicone rubber.

10. The image forming apparatus according to claim 1, wherein the developer has an average particle size smaller than or equal to 6 μm.

* * * * *